US006747620B2

(12) United States Patent
Jun

(10) Patent No.: US 6,747,620 B2
(45) Date of Patent: Jun. 8, 2004

(54) APPARATUS FOR SELF-DIAGNOSING A VIDEO SIGNAL IN AN LCD PANEL AND A METHOD THEREOF

(75) Inventor: Il Jin Jun, Kyungsangbuk-Do (KR)

(73) Assignee: LG Electronics Inc., Seoul (KR)

( * ) Notice: Subject to any disclaimer, the term of this patent is extended or adjusted under 35 U.S.C. 154(b) by 321 days.

(21) Appl. No.: 09/925,689

(22) Filed: Aug. 10, 2001

(65) Prior Publication Data

US 2002/0021294 A1 Feb. 21, 2002

(30) Foreign Application Priority Data

Aug. 11, 2000 (KR) ..... 2000-46545

(51) Int. Cl.[7] ..... G09G 3/36
(52) U.S. Cl. ..... 345/87; 345/904
(58) Field of Search ..... 345/87, 88, 89, 345/3.2, 3.3, 3.1, 3.4, 904, 600, 603, 604, 605, 660, 698, 699

(56) References Cited

U.S. PATENT DOCUMENTS 6,177,946 B1 * 1/2001 Sinclair et al. ..... 345/501
6,275,234 B1 * 8/2001 Iwaki ..... 345/428
6,335,718 B1 * 1/2002 Hong et al. ..... 345/98
6,501,451 B1 * 12/2002 Sakashita ..... 345/87
6,597,370 B1 * 7/2003 Lee ..... 345/660
6,614,448 B1 * 9/2003 Garlick et al. ..... 345/605

* cited by examiner

*Primary Examiner*—Chanh Nguyen
(74) *Attorney, Agent, or Firm*—Jacobson Holman, PLLC

(57) ABSTRACT

An apparatus and method of self-diagnosing a video signal in an LCD panel is disclosed. The apparatus includes a micro-controller, a switching unit and a diagnosis transmitter. The micro-controller generates and outputs a switching control signal representing an operation mode, which includes a self-diagnosis mode and a normal operation mode. The switching unit selects an input signal of a receiver according to the switching control signal from the micro-controller. When the switching control signal represents the self-diagnosis mode, the diagnosis transmitter receives a test video signal having a predetermined display pattern from the micro-controller, and the test video signal is then fed back to the micro-controller. The micro-controller detects whether the test video signal is in trouble by comparing the test video signal from the micro-controller with the video signal fed back to the micro-controller.

11 Claims, 4 Drawing Sheets

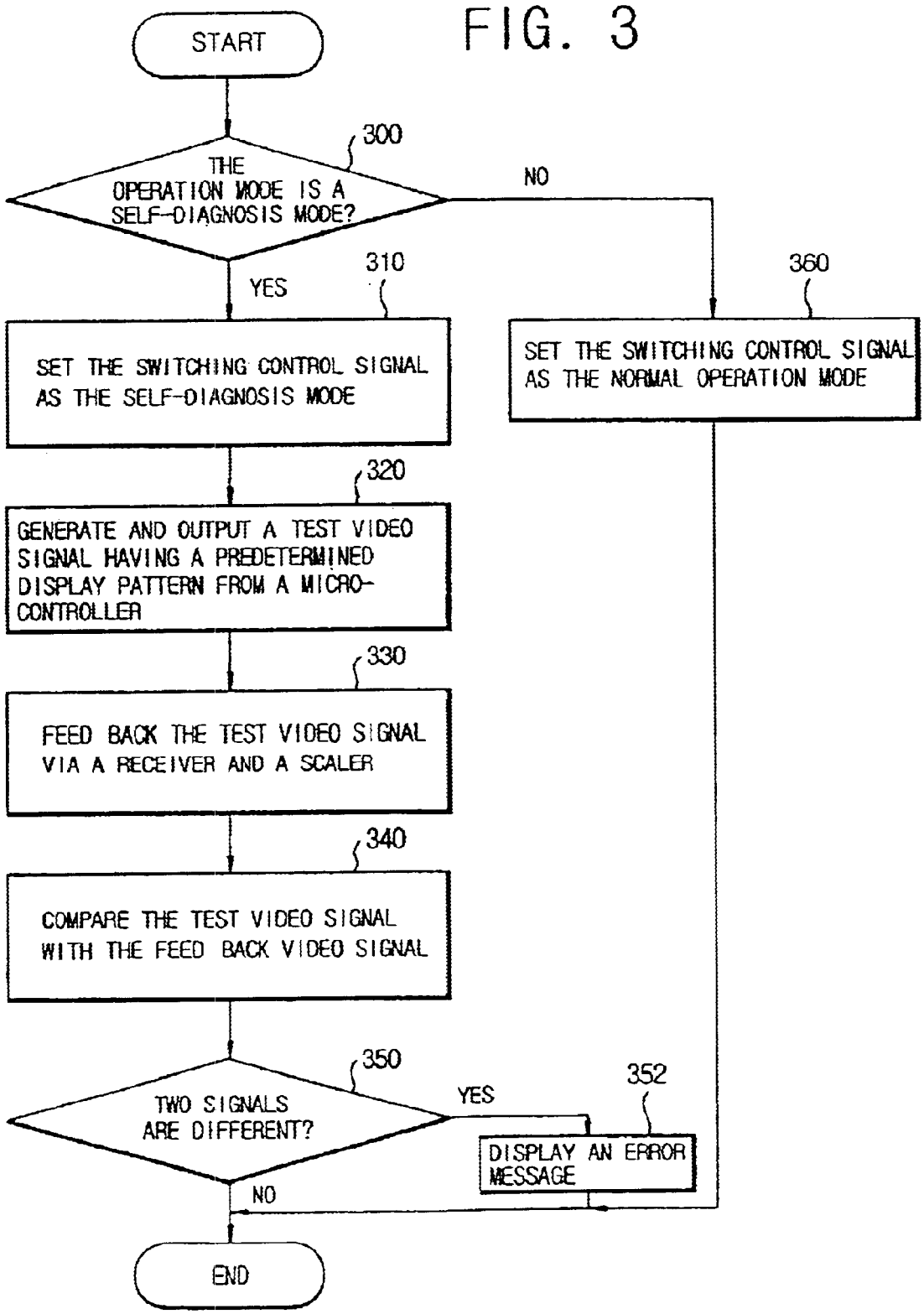
FIG. 3
START
300
THE OPERATION MODE IS A SELF-DIAGNOSIS MODE?
NO
YES
310
360
SET THE SWITCHING CONTROL SIGNAL AS THE SELF-DIAGNOSIS MODE
SET THE SWITCHING CONTROL SIGNAL AS THE NORMAL OPERATION MODE
320
GENERATE AND OUTPUT A TEST VIDEO SIGNAL HAVING A PREDETERMINED DISPLAY PATTERN FROM A MICRO-CONTROLLER
330
FEED BACK THE TEST VIDEO SIGNAL VIA A RECEIVER AND A SCALER
340
COMPARE THE TEST VIDEO SIGNAL WITH THE FEED BACK VIDEO SIGNAL
350
TWO SIGNALS ARE DIFFERENT?
YES
352
DISPLAY AN ERROR MESSAGE
NO
END

APPARATUS FOR SELF-DIAGNOSING A VIDEO SIGNAL IN AN LCD PANEL AND A METHOD THEREOF

BACKGROUND OF THE INVENTION

1. Field of the Invention

The present invention relates in general to an apparatus for driving an LCD panel. More particularly, the present invention relates to an apparatus for self-diagnosing a video signal in an LCD(Liquid Crystal Display) which determines whether or not the video signal is in trouble.

2. Description of the Related Art

FIG. 1 is a block diagram representing a conventional circuit for driving an LCD panel.

Referring to FIG. 1, the conventional circuit for driving the LCD panel includes a micro-controller 130, a receiver 110, a scaler 120 and an interface unit 140. The driving circuit receives an analog video signal from a transmitter 102 of a PC 100, converts the analog video signal into a digital video signal, and transmits the converted video signal to the LCD panel 150.

Specifically, the receiver 110 receives the analog video signal from the PC 100 and converts the analog video signal into the digital video signal, which is composed of digital Red (R), Green (G) and Blue (B) color signals of 8 bits. In general, the receiver 110 includes a video pre-amplifier, an analog-to-digital (A/D) converter and a phase locked loop (PLL) circuit, and is fabricated into one chip.

Next, the scaler 120, which is a digital video processor, converts the digital video signal from the receiver 110 to match the resolution of the video signal with that of the LCD panel. For example, if the input signal to the scaler has a resolution of 800*600 and the resolution of the LCD panel is 1024*768, the scaler scales up the input video signal accordingly.

Generally, the LCD panel adopts an interface format of TTL, LVDS or TMDS, and the interface unit 140 converts the output signal of the scaler 120 to match the interface format adopted by the LCD panel.

The micro-controller 130, which is called a system controller or microcomputer, receives horizontal and vertical sync signals from the PC 100 and signaling equipment, and discriminates an operation mode of the LCD panel from the sync signal and horizontal and vertical frequencies. The micro-controller reads and recognizes mode data stored in a non-volatile memory(not illustrated), and adjusts the operation mode data by controlling an LCD driving circuit.

The micro-controller 130 receives the sync signal from the receiver 110, checks the operation mode from the sync signal and controls the power supply to the inverter 170 and the LCD panel 170 via a power switching unit 160.

The conventional circuit for driving the LCD panel as described above has the problem; it cannot properly detect the trouble state of the scaler 120 and receiver 110. Especially, when a specified bit of digital R, G, B color signals is not processed properly, a user cannot easily detect the trouble.

SUMMARY OF THE INVENTION

Accordingly, it is an object of the invention to provide an apparatus which can detect -the trouble state of the receiver 110 and scaler 120.

Another object of the present invention is to provide an apparatus for self-diagnosing a video signal which can detect whether a specified bit of R, G, B color signals is in trouble.

According to the invention, it may be easily detected if the video signal displayed on the LCD panel has been correctly converted. Therefore, the user can self-diagnose the video signal in the LCD panel.

In one aspect of the present invention, there is provided an apparatus for self-diagnosing a video signal to be displayed in an LCD panel. The apparatus includes a receiver, a scaler, a micro-controller, a diagnosis transmitter and a switching unit.

The receiver receives an analog video signal, and converts the analog video signal into a digital video signal.

The scaler converts said digital video signal from the receiver into a format suitable for the LCD panel.

The micro-controller outputs a switching control signal which represents either a self-diagnosis mode or a normal-operation mode as the operation mode of an LCD driving circuit, and outputs a test video signal having a predetermined display pattern if the switching control signal represents the self-diagnosis mode.

The diagnosis transmitter converts the test video signal into an analog signal.

The switching unit transmits the video signal outputted from the PC to the receiver if the operation mode of the LCD driving circuit is in normal operation mode, while it transmits the test video signal outputted from the diagnosis transmitter to the receiver if the operation mode of the LCD driving circuit is in self-diagnosis mode.

Therefore, the micro-controller detects whether or not the video signal is in trouble by comparing the test video signal from the micro-controller with the video signal processed by and fed back from the receiver and scaler if the operation mode of LCD driving circuit is the self-diagnosis mode.

In another aspect of the present invention, there is provided a method of self-diagnosing whether the video signal is in trouble in an LCD panel. The method comprises the steps of:

(a) providing a digital test video signal having a predetermined display pattern through a micro-controller of an LCD driving circiut;

(b) feeding back the test video signal to the micro-controller via an A/D converter, a receiver and a scaler; and (c) determining whether or not the test video signal is in trouble by comparing the test video signal from the micro-controller with the video signal fed back to the micro-controller.

In a third aspect of the present invention, there is provided a method of self-diagnosing whether the video signal from a PC to an LCD panel is in trouble. The method comprising steps of:

(a) providing a switching control signal through a micro-controller of an LCD driving circuit, said switching control signal representing an operation mode of the LCD driving circuit composed of a self-diagnosis mode and a normal operation mode;

(b) if the operation mode is the self-diagnosis mode, providing a test video signal having a predetermined display pattern through the micro-controller, feeding back the test video signal to the micro-controller via an A/D converter, a receiver and a scaler of the LCD driving circuit, and determining whether or not the test video signal is in trouble by comparing the test video signal from the micro-controller with the video signal fed back to the micro-controller; and (c) if the operation mode of the LCD driving circuit is the normal operation mode, receiving the video signal from the PC, converting the video signal into a signal having a format suitable for the LCD panel, and outputting the video signal to the LCD panel to display the video signal from the PC on the LCD panel.

BRIEF DESCRIPTION OF THE DRAWINGS

Other objects, features and advantages of the present invention will become more apparent by way of the following detailed description of the preferred embodiments. However, it is not intended to limit the invention solely to the embodiments described herein. The description is made with reference to the accompanying drawings, in which:

FIG. 3 is a flowchart illustrating the method of self-diagnosing the video signal according to an embodiment of the present invention.

DETAILED DESCRIPTION OF THE PREFERRED EMBODIMENT

Figure 1:
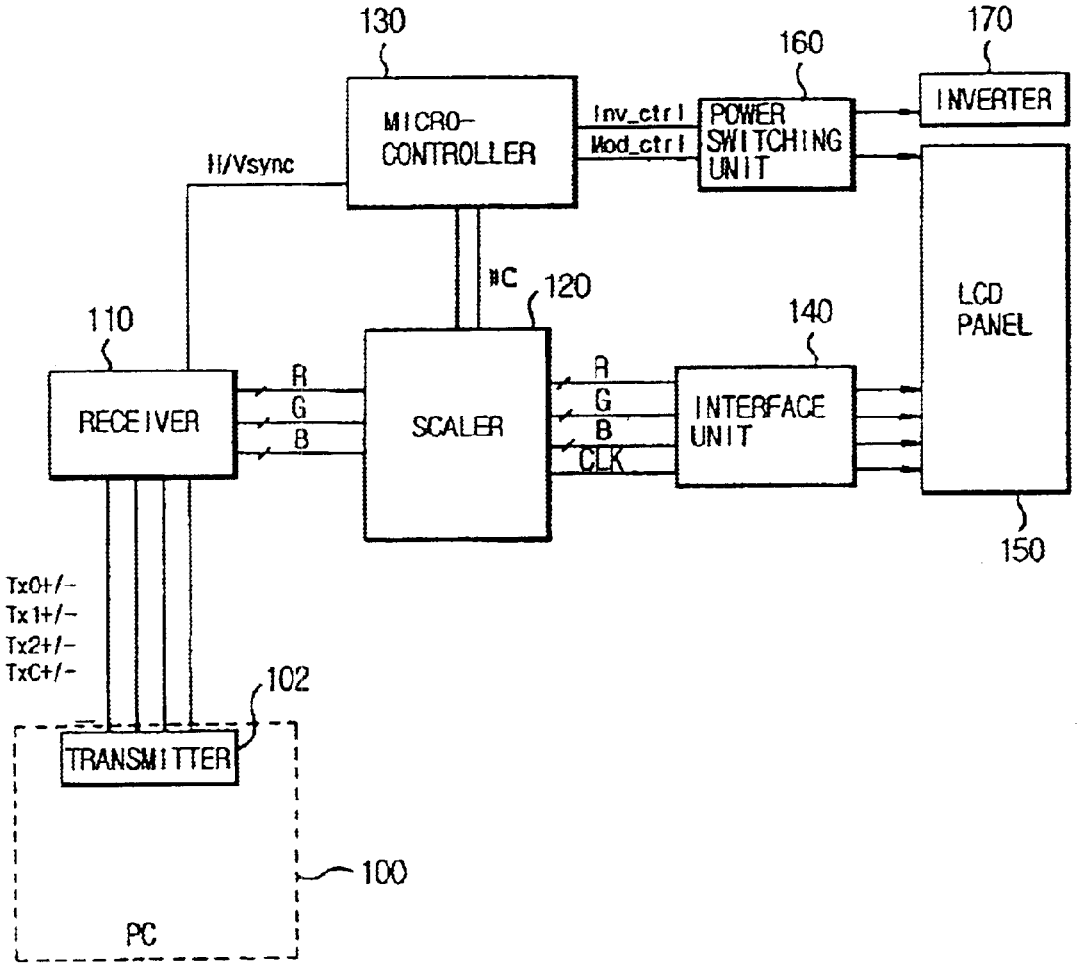
FIG. 1 (PRIOR ART)
FIG. 1 is a block diagram showing a conventional apparatus for driving an LCD panel.
Figure 2:
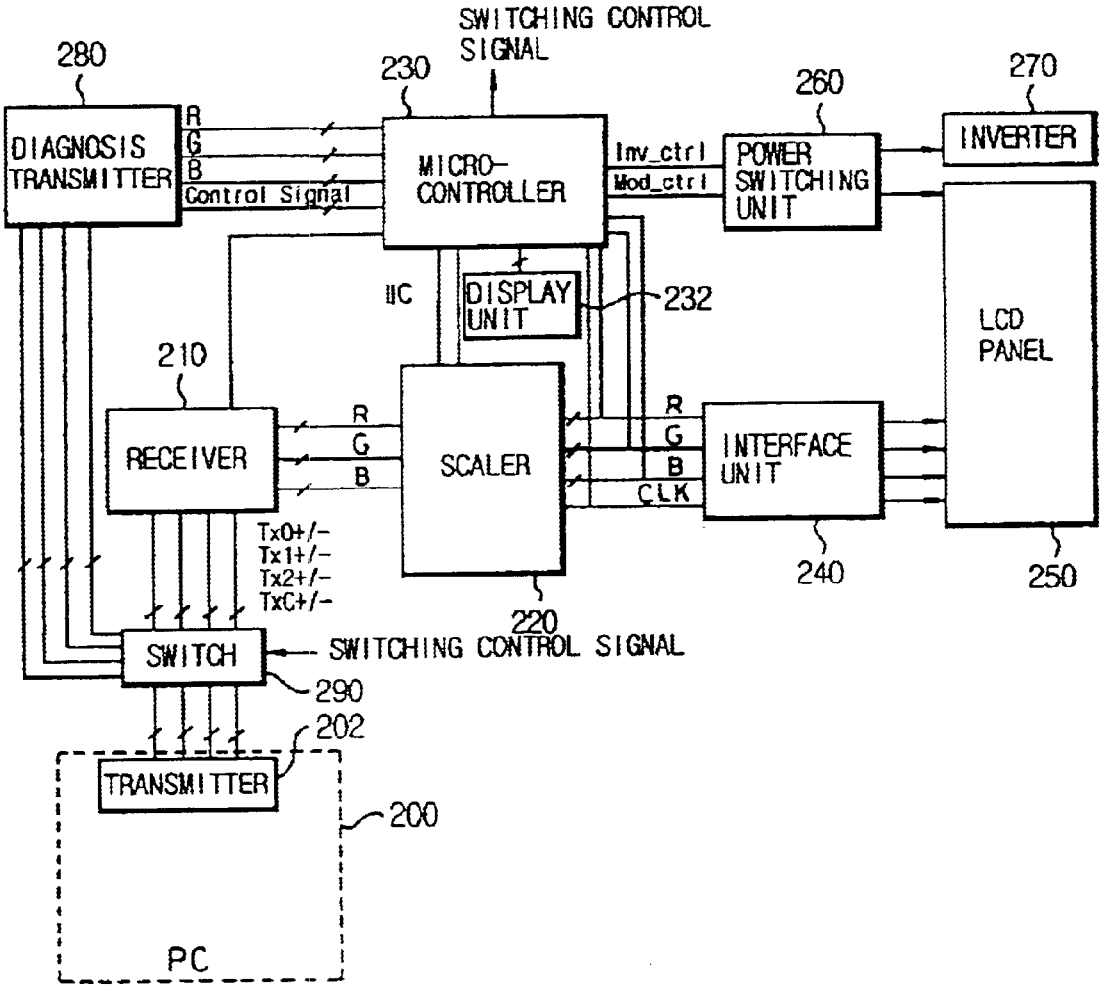
FIG. 2 is a block diagram showing an apparatus for driving an LCD panel having an apparatus for self-diagnosing the video signal according to the present invention.

FIG. 2 is a block diagram illustrating the apparatus which self-diagnoses a video signal in a driving circuit of an LCD panel according to an embodiment of the present invention. The configuration of the apparatus in accordance with the present invention is described in detail as follows with reference to FIG. 2.

The apparatus of the present invention includes a micro-controller 230, a receiver 210, a scaler 220, a diagnosis transmitter 280, a switching unit 290 and a display unit 232.

The micro-controller 230 generates and outputs a switching control signal which determines the operation mode of an LCD. The switching control signal represents a normal operation mode or a self-diagnosis mode. The micro-controller 230 sets the switching control signal as the self-diagnosis mode and outputs a test video signal having a predetermined display pattern.

The diagnosis transmitter 280 receives a digital test video signal from the micro-controller 230, converts the test video signal into an analog video signal, and outputs the converted test video signal.

The switching unit 290 is provided between a transmitter 202 of a PC 200 and the receiver 210 and selects the signal inputted to the receiver in accordance with the switching control signal from the micro-controller. When the switching control signal represents the normal operation mode, the switching unit 290 transmits the video signal from the PC 200 to the receiver 220. However, when the switching control signal represents the self-diagnosis mode, the switching unit 290 transmits the test video signal from the diagnosis transmitter 280 to the receiver 220.

The receiver 220 converts the inputted analog video signal into a digital signal, and outputs the converted video signal to the scaler 220.

The scaler 220 converts the video signal according to the resolution of the LCD panel, and outputs the converted video signal to the interface unit 240. If the operation mode of the LCD driving circuit is the self-diagnosis mode, the converted video signal is fed back to the micro-controller 230.

If the operation mode is in self-diagnosis mode, the micro-controller compares the test video signal outputting from the micro-controller with the video signal fedback to the micro-controller via the switching unit, the receiver and the scaler. Then, the micro-controller determines whether the video signal is in trouble in the LCD driving circuit.

The display unit 232 displays that the video signal is in trouble under the self-diagnosis mode. The display unit 232 may be comprised of an LED. If the scaler of the LCD driving circuit supports the on-screen display, the trouble state is displayed through the on-screen display on the display unit 232.

FIG. 3 is a flowchart illustrating the method of self-diagnosing the video signal according to an embodiment of the present invention. Referring to FIG. 3, the configuration of the apparatus according to the embodiment will now be described.

If a user wants to check whether the bits of the video signal are normally processed in the receiver 210 or the scaler 220, the micro-controller sets the switching control signal as the self-diagnosis mode(step 310).

Then, the micro-controller 230 outputs a test video signal to the diagnosis transmitter 280 and transmits the switching control signal to the switching unit 290. The test video signal is a digital signal and has a predetermined display pattern.

The diagnosis transmitter 280 converts the test video signal into the analog video signal and transmits the converted video signal to the switching unit.

When the switching control signal represents the normal operation mode, the LCD driving circuit operates in the conventional manner. That is, under the normal operation mode, the video signal from the PC is processed through the receiver and the scaler, and displayed on the LCD panel.

However, when the switching control signal represents the self-diagnosis mode, the switching unit receives the test video signal from the diagnosis transmitter 280 and transmits the inputted signal to the receiver 210. The test video signal is inputted to the micro-controller via the receiver and the scaler.

Then, the micro-controller compares the test video signal outputting from the micro-controller with the feedback video signal which has been processed in the receiver and the scaler and inputted again to the micro-controller so as to determine whether or not the test video signal is correctly processed. If there is a trouble, it is displayed on the display unit 232 or through the on-screen display.

Meanwhile, in order to detect the trouble of a specified bit of the video signal, the micro-controller sets the operation mode as the self-diagnosis mode and outputs the test video signal of which the specified bit is in a "high" level.

Then, the test video signal is processed in the diagnosis transmitter, the receiver and the scaler successively, and then inputted to the micro-controller as a feedback video signal. The micro-controller compares the test video signal outputting from the micro-controller with the feedback video signal inputted to the micro-controller so as to detect the trouble of the video signal.

FIG. 3 is a flowchart illustrating the method of detecting the trouble of the video signal according to the embodiment of the present invention.

As shown in FIG. 3, the micro-controller sets the switching control signal as a self-diagnosis mode(step 310).

Then, at step 320, the micro-controller generates and outputs the test video signal having a predetermined display pattern. Then, the test video signal from the micro-controller is inputted to the micro-controller as a feedback video signal via the receiver and the scaler(step 330). The micro-controller compares the test video signal with the feedback video signal to detect the difference between the two signals (step 340).

If there is a difference, it is notified on the display unit or through the on-screen display(step 350), and the operation is terminated.

Figure 4:
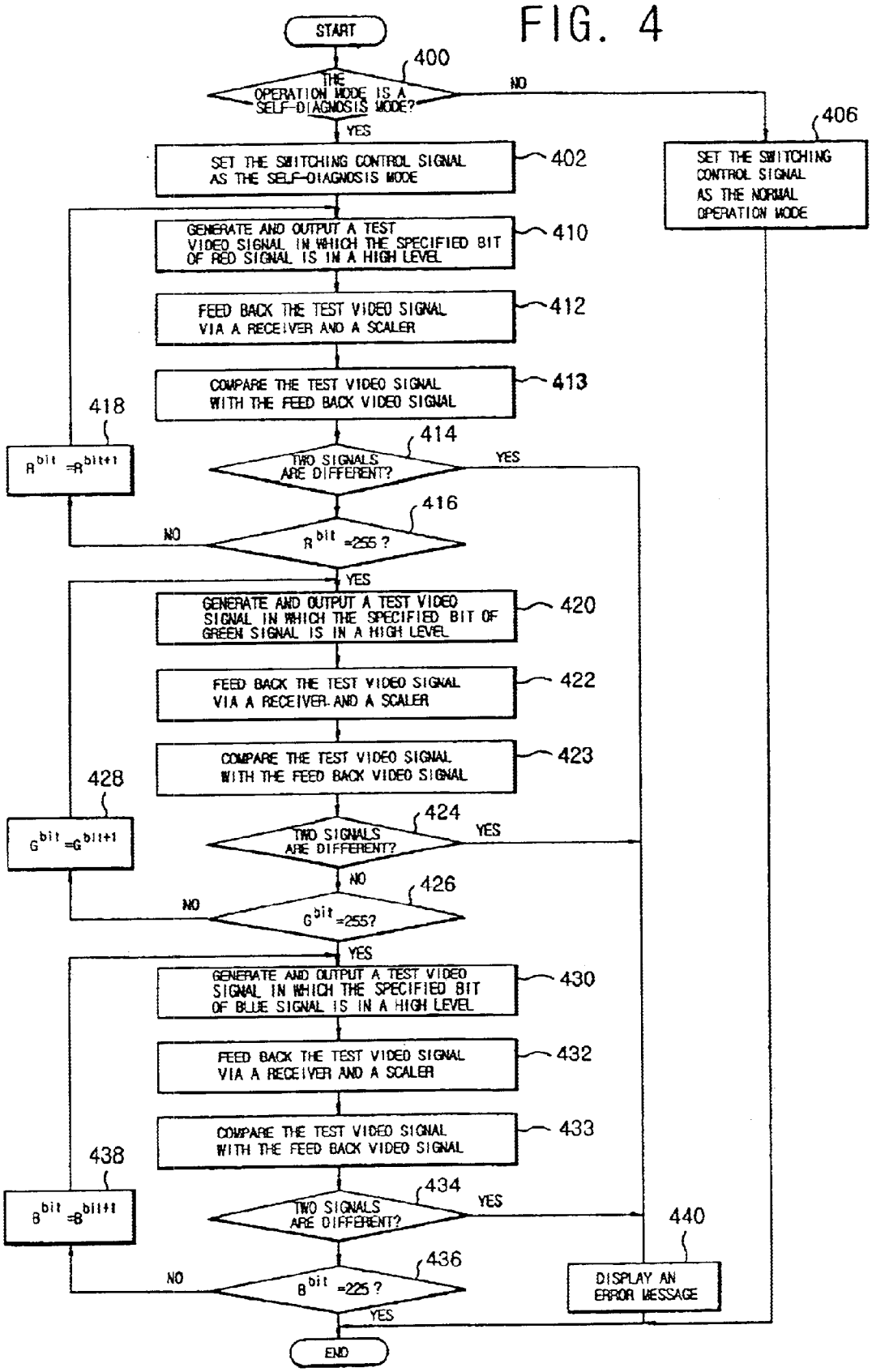
FIG. 4 is a flowchart illustrating the method of self-diagnosing the video signal according to another embodiment of the present invention.

FIG. 4 is a flowchart illustrating the method of detecting the trouble of the video signal according to another embodiment of the present invention.

The micro-controller sets the switching control signal as a self-diagnosis mode(step 402).

Then, the micro-controller outputs the test video signal of which the first bit is in a high level(step 410). Then, the test video signal from the micro-controller is inputted to the micro-controller as a feedback video signal via the receiver and the scaler(step 412) The micro-controller compares the test video signal with the feedback video signal to determine the difference between the two signals(step 414).

If there is no difference, the micro-controller outputs the test video signal of which the next bit is set as a "high" level and returns to the step 312. If there is a difference, it is notified on the display unit or through the on-screen display.

The above-described steps are repeated with respect to G and B color signals of the test video signal.

Accordingly, it can be checked whether all the bits of the video signal are correctly processed.

As described above, according to the present invention, the self-diagnosis apparatus can be used for detecting an abnormal bit of the video signal so as to self-diagnose the scaler or receiver of the LCD.

It should be understood that the present invention is not limited to the particular embodiments disclosed herein as the best mode contemplated for carrying out the present invention. It is intended to cover various modifications and similar arrangements included within the spirit and scope of the claims. Also, it is intended that the scope of the present invention be defined by the following claims and their equivalents.

What is claimed is:

1. An apparatus for self-diagnosing a video signal to be displayed on an LCD panel, comprising:

a receiver for receiving an analog video signal, and converting the analog video signal into a digital video signal;

a scaler for converting said digital video signal from the receiver into a format suitable for the LCD panel;

a micro-controller for outputting a switching control signal which represents either a self-diagnosis mode or a normal-operation mode as an operation mode of an LCD driving circuit, and outputting a test video signal having a predetermined display pattern if the switching control signal represents the self-diagnosis mode;

a diagnosis transmitter for converting the test video signal into an analog signal; and a switching unit for transmitting the video signal outputted from the PC to the receiver if the operation mode of the LCD driving circuit is in normal operation mode, while transmitting the test video signal outputted from the diagnosis transmitter to the receiver if the operation mode of the LCD driving circuit is in self-diagnosis mode;

wherein the micro-controller detects whether or not the video signal is in trouble by comparing the test video signal from the micro-controller with the video signal processed by and fed back from the receiver and scaler if the operation mode of LCD driving circuit is in self-diagnosis mode.

2. The apparatus according to claim 1, further comprising a display unit for informing a trouble state of the LCD driving circuit if the micro-controller detects the trouble state of the LCD driving circuit.

3. The apparatus according to claim 1, further comprising an on-screen display for informing a trouble state of the LCD driving circuit if the micro-controller detects the trouble state of the LCD driving circuit.

4. The apparatus according to claim 1, wherein if the switching control signal represents the self-diagnosis mode, the micro-controller outputs the test video signal having the predetermined display pattern, the test video signal is fed back to the micro-controller through the diagnosis transmitter, receiver and scaler, and the micro-controller detects whether or not the video signal is in trouble by comparing the test video signal outputted from the micro-controller with the video signal fed back to the micro-controller.

5. The apparatus according to claim 4, wherein the micro-controller repeats detection of a trouble state with respect to all bits of the video signal.

6. A method of self-diagnosing whether or not a video signal inputted from a PC is in trouble in an LCD panel, the method comprising the steps of:

(a) providing a digital test video signal having a predetermined display pattern through a micro-controller of an LCD driving circuit;

(b) feeding back the test video signal to the micro-controller via an A/D converter, a receiver and a scaler; and (c) determining whether or not the test video signal is in trouble by comparing the test video signal from the micro-controller with the video signal fed back to the micro-controller.

7. The method according to claim 6, wherein the test video signal has a specified bit of a high level as a testing bit.

8. The method according to claim 6, further comprising the step of notifying that the test video signal is in trouble.

9. The method according to claim 8, wherein the trouble notifying step is performed using an on-screen display.

10. A method of self-diagnosing whether or not a video signal from a PC to an LCD panel is in trouble, the method comprising steps of:

(a) providing a switching control signal through a micro-controller of an LCD driving circuit, said switching control signal representing an operation mode of the LCD driving circuit composed of a self-diagnosis mode and a normal operation mode;

(b) if the operation mode is the self-diagnosis mode, providing a test video signal having a predetermined display pattern through the micro-controller, feeding back the test video signal to the micro-controller via an A/D converter, a receiver and a scaler of the LCD driving circuit, and determining whether or not the test video signal is in trouble by comparing the test video signal from the micro-controller with the video signal fed back to the micro-controller; and (c) if the operation mode of the LCD driving circuit is in normal operation mode, receiving the video signal from the PC, converting the video signal into a signal having a format suitable for the LCD panel, and outputting the video signal to the LCD panel to display the video signal from the PC on the LCD panel.

11. The method according to claim 10, further comprising the step of notifying that the test video signal is in trouble through an on-screen display.

* * * * *